US007753832B2

(12) United States Patent
Karine et al.

(10) Patent No.: US 7,753,832 B2
(45) Date of Patent: Jul. 13, 2010

(54) METHOD AND EQUIPMENT FOR MOULDING AN ARTICLE PRODUCED FROM PAPERBOARD

(75) Inventors: Seppo Karine, Imatra (FI); Jari Räsänen, Imatra (FI)

(73) Assignee: Stora Enso Oyj, Helsinki (FI)

( * ) Notice: Subject to any disclaimer, the term of this patent is extended or adjusted under 35 U.S.C. 154(b) by 0 days.

(21) Appl. No.: 10/508,581

(22) PCT Filed: Apr. 8, 2003

(86) PCT No.: PCT/FI03/00262

§ 371 (c)(1),
(2), (4) Date: Sep. 22, 2004

(87) PCT Pub. No.: WO03/084739

PCT Pub. Date: Oct. 16, 2003

(65) Prior Publication Data

US 2005/0164859 A1 Jul. 28, 2005

(30) Foreign Application Priority Data

Apr. 9, 2002 (FI) ..... 20020671

(51) Int. Cl.
*B31B 1/66* (2006.01)

(52) U.S. Cl. ..... 493/143; 493/158; 493/174; 493/185; 493/395

(58) Field of Classification Search ..... 493/174–176, 493/185, 395, 158, 143; 264/479, 489; 425/174.4
See application file for complete search history.

(56) References Cited

U.S. PATENT DOCUMENTS 3,336,847 A * 8/1967 Durat ..... 493/27
5,215,634 A * 6/1993 Wan et al. ..... 204/157.9
5,313,167 A * 5/1994 Marshall ..... 324/632
5,431,619 A * 7/1995 Bacon et al. ..... 493/158
5,637,332 A 6/1997 Ridout ..... 425/356
5,759,624 A * 6/1998 Neale et al. ..... 427/261
6,077,377 A * 6/2000 Bentz et al. ..... 156/195

(Continued)

FOREIGN PATENT DOCUMENTS

CN 1282819 2/2001

(Continued)

OTHER PUBLICATIONS

Japanese Office Action (with translation) from Japanese Patent Application No.: 581963/2003, dated Oct. 7, 2008.

(Continued)

*Primary Examiner*—Hemant M Desai
(74) *Attorney, Agent, or Firm*—Ohlandt, Greeley, Ruggiero & Perle, L.L.P.

(57) ABSTRACT

A method and equipment for molding an article produced from paperboard or cardboard. Moulding is carried out by a molding tool that mechanically works the board; and to improve its moldability, momentary irradiation on the microwave frequency is exerted on the board. The method applies to the manufacture of packages and disposable containers made of paperboard or cardboard; for example, to the forming of a rolled-up or folded rim around a drinking cup, mug or a container, the forming of a stiffening crease or projection on a paperboard container, or to press molding of paperboard containers or plates.

11 Claims, 4 Drawing Sheets

U.S. PATENT DOCUMENTS

| | | | | |
|---|---|---|---|---|
| 6,120,426 | A * | 9/2000 | Bacon | 493/109 |
| 2002/0012759 | A1 | 1/2002 | Asayama et al. | 428/34.2 |
| 2005/0257878 | A1 * | 11/2005 | Thomas et al. | 156/195 |

FOREIGN PATENT DOCUMENTS

| | | |
|---|---|---|
| EP | 0 909 634 A2 | 4/1999 |
| JP | 2001301737 | 10/2001 |
| JP | A-2002-036395 | 2/2002 |
| JP | A-H07-214705 | 8/2005 |
| WO | WO 99/64213 | 12/1999 |
| WO | WO 02/00522 | 1/2002 |

OTHER PUBLICATIONS

Decision of Refusal (with translation) dated Aug. 11, 2009 from corresponding Japanese Patent Application No.: 581963/2003.

* cited by examiner

METHOD AND EQUIPMENT FOR MOULDING AN ARTICLE PRODUCED FROM PAPERBOARD

This is a 371 National stage application of International application no. PCT/FI03/00262, filed on Apr. 8, 2003, which claims priority to Finnish application no. 20020671, filed on Apr. 9, 2002.

FIELD OF THE INVENTION

The invention relates to a method for mechanically moulding an article that is produced from paperboard or cardboard. The invention also relates to equipment for applying the method.

DISCUSSION OF THE BACKGROUND ART

Containers, disposable tableware and packages are made of paperboard by means of a technique comprising the following typical stages of operation: cutting a blank from a board web, folding and/or bending and joint sealing the blank to give the item being made its final shape. Paperboard containers and plates are also produced by press-moulding or deep-drawing the blank. Other moulding machining operations of paperboard products include providing paperboard containers, such as cups and mugs, with a rolled-up or creased rim or a so-called mouth roll, and forming annular reinforcing ribs or similar creases on the sides of the paperboard vessels or packages.

In the press moulding of paperboard articles, the blank is brought between a pair of heated press moulds, whereby the paperboard bends or folds under compression, forming creases on the rim or in the corners of the article thus formed. Heating is necessary to make the deformation of the paperboard permanent. Press moulding has been used in the manufacture of foodstuff dishes and plates made of paperboard in particular.

The purpose of the mouth roll that is formed on paperboard drinking cups and mugs, on the one hand, is to stiffen the cup and, on the other hand, to provide the desired touch with the user's mouth, when enjoying a beverage. The mouth roll is provided by a tool that bends and/or presses the paperboard, mostly at the final stage of manufacture of a cup that is already bent and sealed. To make the mouth roll sufficiently tight and permanent, a heated tool is used, as well as additives, such as oils, and moistening of the paperboard. However, as fluctuations in the moisture of air have an effect on it, the moistening of the paperboard in particular is difficult to control in practice; in addition, moistened paperboard tends to warp or, when becoming too damp, completely loses its stiffness.

SUMMARY OF THE INVENTION

The purpose of the invention is to provide a new solution for the mechanical moulding of paperboard articles, such as containers, tableware, packages and similar products, avoiding the problems of prior art mentioned above. The method according to the invention is characterized in that a spot of the board is moulded mechanically by means of a moulding tool while irradiation of microwave-frequency is Simultaneously exerted on said spot.

The basic idea of the invention is to provide a local effect of radiation that heats the spot of the board that is to be moulded and makes the board deformable for the time the heating is maintained. As the board does not require moistening or the use of oil or other similar additives, and there is no need to heat the actual moulding tools, the moulding is easy to control.

According to the invention, microwave radiation is exerted on the mouldable spots of the board, its frequency being in the range of 1 to 1000 GHz (corresponding to a wavelength interval of about 0.03-30 cm), preferably in the range of 2 to 100 GHz, the radiation being absorbed by the board. Paperboard or cardboard intrinsically contains about 5 to 9% of moisture; whereby there are water molecules attached to the free hydroxyl groups in the cellulose fibres, forming bridges between the fibres. The radiation hitting the board instantly vaporizes the water so that the bonds between fibres are dissolved, while heat is absorbed by the board. The board thus turns plastic for a moment, and it can be worked mechanically. When the board solidifies into the form it has been given by the mechanical, the result of the moulding operation becomes permanent.

In the invention, a radiation frequency of 2.45 GHz can be used (corresponding to a wavelength of 12.2 cm), which is standard in conventional microwave ovens made for cooking. The frequency in question is somewhat below the absorption peak of water, its purpose being to prevent the heating effect from excessively concentrating on the surface layer of the food. However, as the object of irradiation of the invention is a fairly thin board, the most preferable frequency range that maximally utilizes the radiation is slightly higher, closer to the absorption peak of water.

In the invention, the irradiation pulse is sufficient, if it vaporizes the moisture contained by the board in the area that is moulded. It is preferable, if in momentary heating the moisture evaporates inside the board without exiting the board. In practice, the duration of the irradiation pulse can be about 0.1 to 1.0 seconds, corresponding to the time it takes to mould a single article in mass production. It is preferable to start irradiation slightly before starting the mechanical working by the tool.

The mechanical moulding of board products according to the invention can comprise measures that bend, fold or press the board, or combinations thereof. The essential objects of the invention include local expansions, protrusions or reinforcements that are provided on board articles, such as the rolled-up or creased rims of cups, mugs or plates. Similarly, further objects of the invention include creases or projections formed to the sides of the board articles, such as containers or packages, circling around them for the purpose of stiffening the article. Other objects of the invention comprise press moulding or deep drawing paperboard or cardboard articles, such as containers and plates, wherein the moulding provides bent or folded creases in the corners of the article or annularly on the rim of the article.

The equipment according to the invention for moulding articles of paperboard or cardboard in accordance with the description above comprises not only the moulding tool that mechanically works the spot of the board that is to be moulded, but also a source of radiation that produces radiation on the microwave frequency, from which source an irradiation pulse of a short duration can be directed at the mouldable spot of the board. The source of radiation can selectively be installed as part of the moving moulding tool, part of the stationary counterpart of the moving tool or completely separate from the moulding tool and its counterpart.

BRIEF DESCRIPTION OF THE DRAWINGS

In the following, the invention is explained in detail with the aid of examples and with reference to the appended drawings, in which.

DETAILED DESCRIPTION OF THE PREFERRED EMBODIMENT

Figure 1:
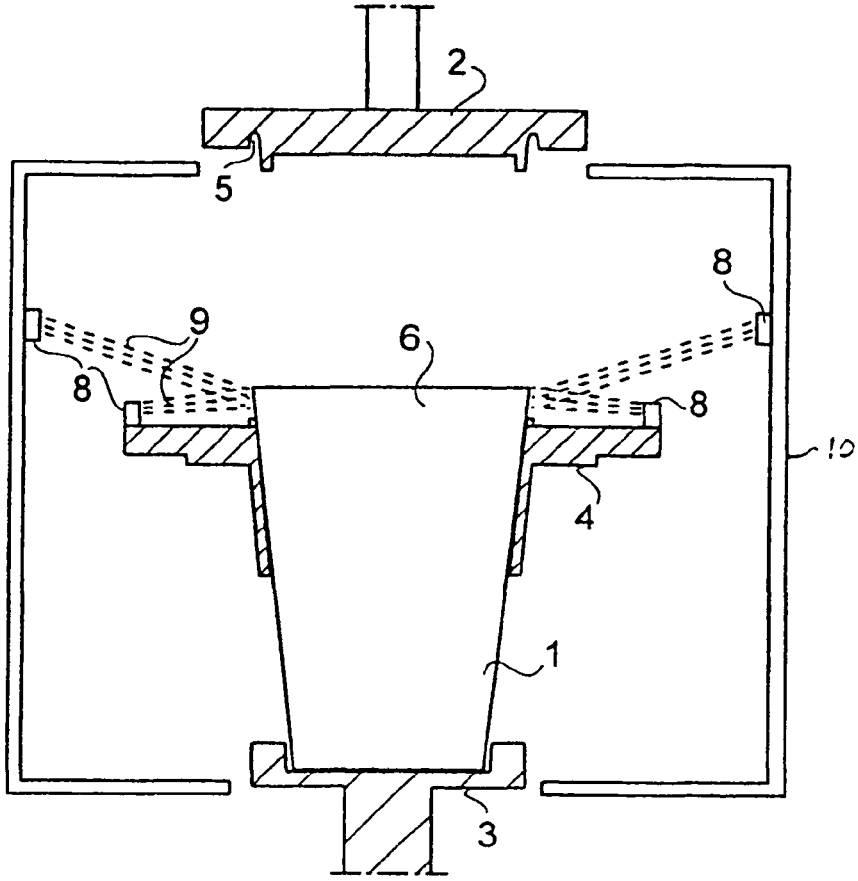
FIG. 1 shows the moulding of a mouth roll around the mouth of a paperboard drinking cup by means of irradiators and a moulding tool at the home position of the motion of the tool parts.
Figure 2:
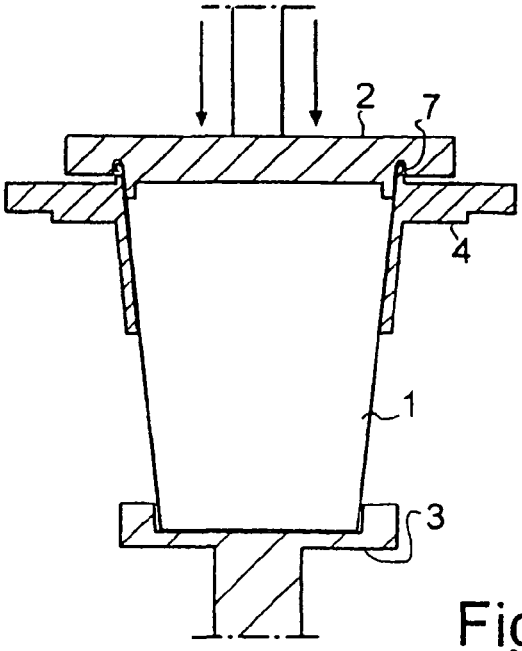
FIG. 2 shows the tool according to FIG. 1 coming to the end point of its movement, wherein the mouth roll is formed on the mouth of the cup.

The tool according to FIGS. 1 and 2 for moulding the mouth roll on a paperboard drinking cup 1 comprises a vertically reciprocating striking tool 2, a stationary base 3 that supports the cup, and a carrier ring 4 that supports the side of the cup and works as the stationary counterpart for the striking tool. For forming the mouth roll, an annular groove 5 is formed on the lower surface of the striking tool 2. In the home position of the moulding movement according to FIG. 1, the drinking cup 1, the rolling of the mouth of which is the last stage of operation in its manufacturing process, is supported by the base 3 and the carrier ring 4 so that the rim 6 of the cup rises slightly above the surface of the carrier ring. While the striking tool 2 carries out its working motion that is directed downwards from the position in FIG. 1, the rim 6 of the cup projects into the groove 5, which forces the rim to bend out and down and to roll up to form a projecting expansion around the mouth of the cup, wherein the rim is twisted, for example, by about one and a half revolutions before the striking tool 2 hits the counterpart 4.

In order to make the cup board mouldable and the mouth roll 7 thus formed permanent, an irradiation pulse on the microwave frequency is directed from the irradiators 8 towards the rim 6 of the cup, the pulse being indicated by broken lines 9 in FIG. 1. Irradiation may be started just before the tool 2 comes into contact with the cup 1, and will be continued during the moulding operation, preferably up to the moment the tool 2 hits the counterpart 4. Depending on the humidity of the ambient air, the moisture content of the paperboard is in the range of 5 to 9%. The radiation frequency can be, for example, 2.45 GHz, which is used in conventional microwave ovens, and the pulse duration can be 0.1 seconds, for example. To prevent the radiation from spreading, the irradiators 8 are installed inside a protecting casing 10 that surrounds the cup 1. In FIG. 1, there are irradiators 8 arranged on both the inner surface of the protective casing 10 and in the carrier ring 4 surrounding the cup, but, in practice, it is sufficient to have irradiators installed in only one of them. Installing the irradiators in the moving striking tool 2 would also be feasible. The purpose of the irradiation is to heat the cup board at the rim 6 of the cup so that the humidity contained by the paperboard evaporates for the time the mouth roll 7 is being formed from the rim. The evaporation of water and the resulting heating of the paperboard make the paperboard deformable for a moment, whereby the mouth roll formed on the cup remains permanent, because the paperboard cools off and returns to its normal rigidity immediately after the forming.

Figure 3:
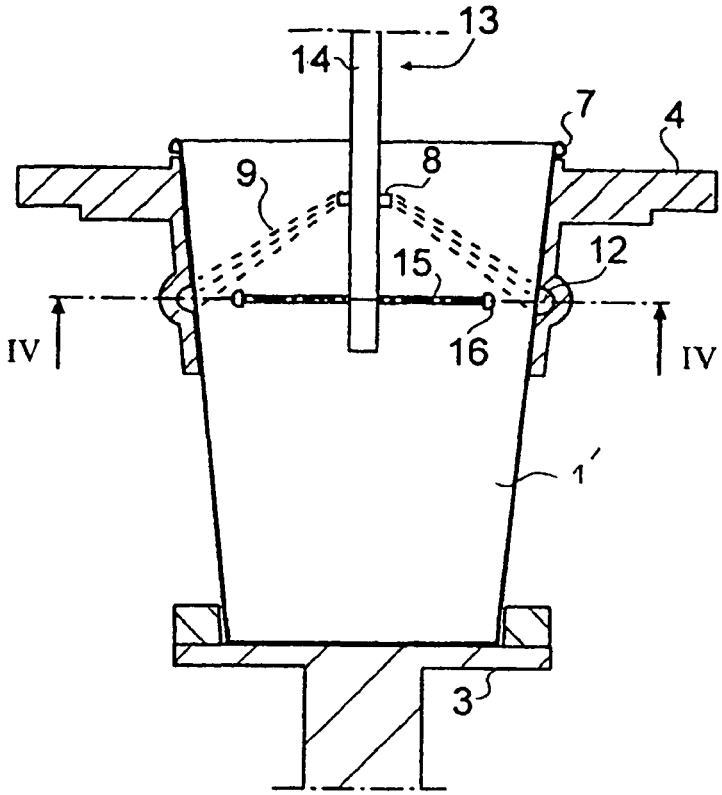
FIG. 3 shows a moulding tool that produces an annular, projecting crease to the side of the drinking cup, FIG. 4, which is the section IV-IV of FIG. 3, shows the moulding tool in the home position of its movement.
Figure 4:
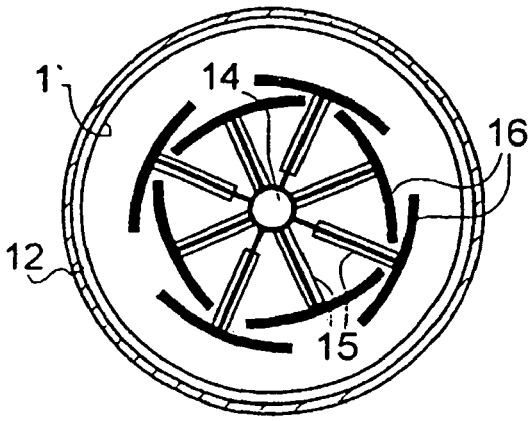
Figure 5:
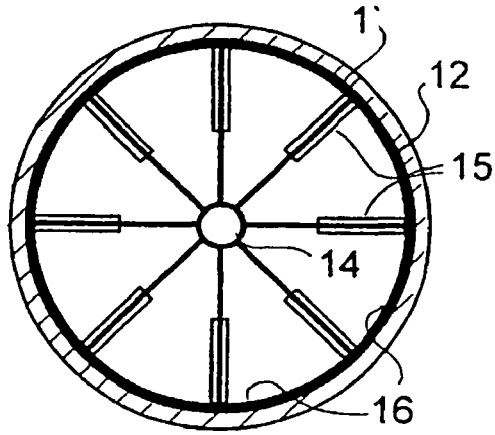
FIG. 5 shows the moulding tool at the end point of its movement, corresponding to FIG. 4.
Figure 7:
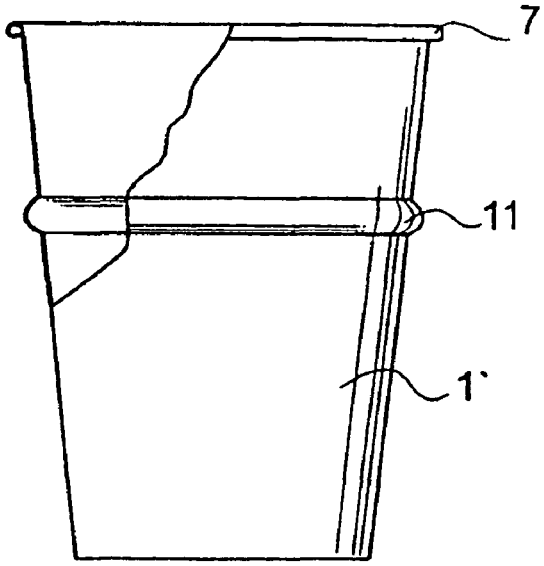
FIG. 7 shows a drinking cup comprising, in addition to the mouth roll, a projecting, annular crease moulded thereon by means of the moulding tool according to FIGS. 3 to 5.

FIGS. 3 to 5 show a moulding process, wherein an annular crease 11 that stiffens the cup and projects form the side of the cup is formed on a paperboard drinking cup 1' (cf FIG. 7). The cup 1' is placed on the base 3 and supported at its side by the carrier ring 4 in a similar fashion as in FIGS. 1 and 2. An annular groove 12 is formed on the surface of the carrier ring 4 that supports the cup, its shape corresponding to the crease that is to be made in the cup. The moving moulding tool 13 is lowered inside the cup 1' so that its lower end is level with the groove 12 of the carrier ring. The irradiators 8 are installed on the vertical axis 14 of the moving tool 13, and an irradiation pulse 9 on the microwave frequency is exerted on the side of the cup at the point where the crease is to be formed. The frequency and the duration of the irradiation can be as those mentioned in connection with FIGS. 1 and 2.

The operation of the moulding tool 13 in forming the crease 11 is illustrated in FIGS. 4 and 5. Curved clamping parts 16 are connected to the vertical axis 14 of the tool 13 by means of horizontal telescope arms 15, corresponding to the groove 12 of the carrier ring and the crease 111 that is to be created; the parts being shown in FIG. 4 in their retracted home positions corresponding to. FIG. 3 and, in FIG. 5, as projecting into the groove of the carrier ring, whereby the side of the cup 1' is pressed between the clamping parts 16 that are arranged into a ring and the bottom of the groove 12. The crease 11, which is provided by the heating produced by the momentary irradiation pulse 9, and which corresponds to the recession, thus remains permanent.

Figure 6:
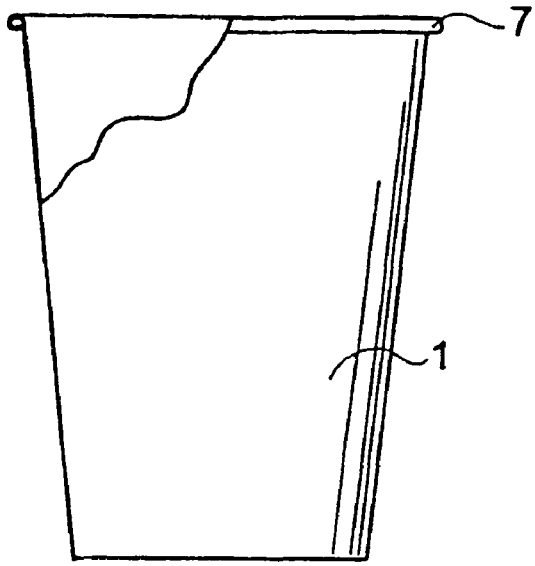
FIG. 6 shows a drinking cup made of paperboard with a mouth roll moulded by means of the moulding tool according to FIGS. 1 and 2.

FIGS. 6 and 7 show finished paperboard drinking cups 1, 1', which are formed according to the invention. The drinking cup 1 according to FIG. 6 is provided with a mouth roll 7, which can be made by means of the moulding process described in FIGS. 1 and 2. The drinking cup 1' according to FIG. 7 is provided, in addition to the mouth roll 7, with an annular crease 11, which projects from the side of the cup and which can be made by means of the moulding process described in FIGS. 3 to 5.

Figure 8:
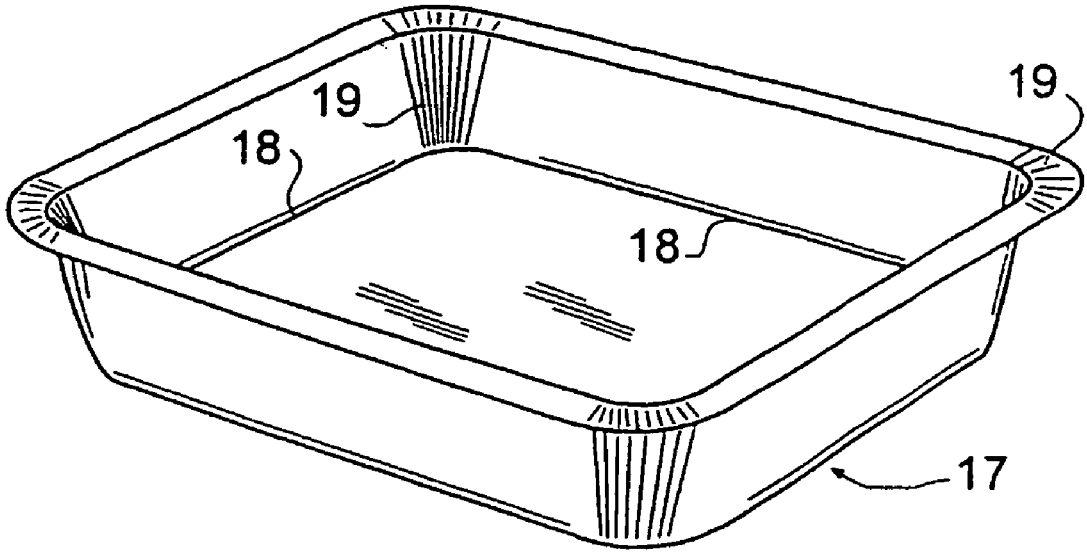
FIG. 8 shows a frozen food paperboard container, which is moulded by press moulding combined with irradiation.
Figure 9:
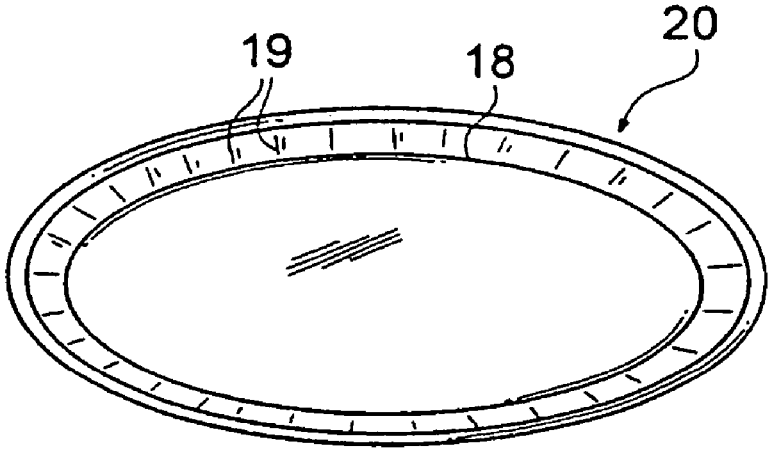
FIG. 9 shows a disposable plate made of paperboard and moulded by a corresponding method.

The mechanical moulding of board products according to the invention, utilizing irradiation on the microwave frequency, can also be applied to products made by means of press moulding or deep-drawing. In the manufacture of the products, conventional moulding tools as such can be used, having irradiators installed therein as accessories, and an irradiation pulse on the microwave frequency can be directed from the irradiators to the spots of the board that are to be moulded. FIG. 8 shows an example of a frozen food paperboard container 17, which, in this way, is press-moulded from a blank, its folds 18 and/or corrugations 19 of the corners being formed by means of irradiation. FIG. 9 shows a disposable paperboard plate 20, which is formed from a blank in a similar manner.

It is obvious to those skilled in the art that the different applications of the invention are not limited to the above examples, but can vary within the following claims.

The invention claimed is:

1. A method for mechanically moulding a mouth roll around a mouth of a drinking cup or mug an article that is produced from paperboard or cardboard, comprising:

moulding the mouth of the drinking cup or mug mechanically by a molding tool; and simultaneously exerting microwave irradiation consisting of a single irradiation pulse on the mouth to provide a local heating effect, wherein the frequency of the radiation used is 1 to 1000 GHz and the duration of the irradiation pulse is about 0.1 to 1.0 seconds.

2. A method according to claim 1, wherein the frequency of the radiation used is 2 to 100 GHz.

3. A method according to claim 1, wherein the irradiation is sufficient for evaporating the moisture contained by the mouth being moulded.

4. A method according to claim 1, wherein an irradiation pulse of a short duration is exerted on the mouth that is being moulded, said pulse momentarily evaporating humidity contained by the mouth without causing a significant exit of moisture from the mouth.

5. A method according to claim 1, wherein the mouth is moulded by bending, folding and/or pressing.

6. A method for mechanically moulding a mouth roll around a mouth of a drinking cup or mug that is produced from paperboard or cardboard, comprising:

moulding the mouth mechanically by a molding tool; and simultaneously exerting microwave irradiation consisting of a single irradiation pulse on the mouth to provide a local heating effect, wherein the irradiation is started before the mouth is to be molded is worked by the molding tool.

7. An equipment for moulding a mouth roll around a mouth of a drinking cup or mug an article produced from paperboard or cardboard, comprising:

a moulding tool that mechanically works the mouth; and irradiators being configured to exert and direct a single irradiation pulse of a short duration on the mouth that is being molded to provide a local heating effect simultaneous to the moulding tool mechanically working the mouth, wherein the frequency of the radiation used is 1 to 1000 GHz and the duration of the irradiation pulse is about 0.1 to 1.0 seconds.

8. Equipment according to claim 7, wherein the source of radiation is installed as part of a moving moulding tool.

9. Equipment according to claim 7, wherein the source of radiation is installed as part of a stationary counterpart of the moulding tool.

10. Equipment according to claim 7, wherein the source of radiation is a separate part from the moulding tool and/or the counterpart.

11. Equipment according to claim 7, wherein the equipment is surrounded with a protective casing, which prevents the microwaves from spreading into the environment.

* * * * *